US005332028A

United States Patent [19]

Marris

[11] Patent Number: 5,332,028

[45] Date of Patent: Jul. 26, 1994

[54] METHOD AND APPARATUS FOR CONTROLLING SUPPLEMENTAL ELECTRIC HEAT DURING HEAT PUMP DEFROST

[75] Inventor: Derrick A. Marris, Mooresville, Ind.

[73] Assignee: Carrier Corporation, Syracuse, N.Y.

[21] Appl. No.: 31,155

[22] Filed: Mar. 12, 1993

[51] Int. Cl.[5] ..... F25B 29/00

[52] U.S. Cl. ..... 165/1; 165/29; 62/160; 237/2 B; 219/486

[58] Field of Search ..... 165/29, 1; 62/160; 237/2 B; 219/486; 236/1 EA, 1 ER, 36

[56] References Cited

U.S. PATENT DOCUMENTS

| | | | |
|---|---|---|---|
| 2,951,640 | 9/1960 | Buchanan | 236/1 ER |
| 2,975,611 | 3/1961 | Pietsch | 62/160 |
| 3,006,613 | 10/1961 | Coyne | 62/160 |
| 3,283,809 | 11/1966 | Eberhart | 62/160 |
| 3,734,810 | 5/1973 | Davis | 165/29 |
| 4,102,390 | 7/1978 | Harnish et al. | 165/29 |
| 4,141,408 | 2/1979 | Garnett | 165/29 |
| 4,143,707 | 3/1979 | Lewis et al. | 62/160 |
| 4,462,460 | 7/1984 | Braver | 62/160 |
| 4,474,227 | 10/1984 | Reedy | 62/160 |
| 4,534,179 | 8/1985 | Stocking et al. | 62/160 |
| 4,543,796 | 10/1985 | Han et al. | 62/160 |
| 5,081,846 | 1/1992 | Dudley et al. | 62/160 |

FOREIGN PATENT DOCUMENTS

| | | | |
|---|---|---|---|
| 99695 | 8/1940 | Sweden | 236/36 |

*Primary Examiner*—John K. Ford

[57] ABSTRACT

In a heat pump system having supplemental heat for application to the supply air during periods of defrost operation, a "cold blow" condition is avoided by turning on a supplemental heater and by sensing the temperature of the supply air and responsively turning on additional heat in stages when necessary to maintain the temperature level of the supply air at a comfortable level.

14 Claims, 3 Drawing Sheets

METHOD AND APPARATUS FOR CONTROLLING SUPPLEMENTAL ELECTRIC HEAT DURING HEAT PUMP DEFROST

BACKGROUND OF THE INVENTION

The invention relates generally to heat pump systems and, more particularly, to a method and apparatus for controlling supplemental electric heat during the process of defrosting the outdoor coil thereof.

In conventional heat pump system operation, when the system is operating in the heating mode with the outdoor coil acting as an evaporator, the formation of frost or ice on the heat exchanger surface is a common phenomenon. That is, under appropriate ambient conditions, the media in flowing heat transfer relationship with the evaporator, typically air, has its temperature lowered below its dew point, thus causing condensation to form on the coil. If ambient temperature conditions are sufficiently low, this condensation will then be caused to freeze. That is, since the heat pump operating in the heating mode requires refrigerant to be at a lower temperature than the ambient air in order to transfer heat to the refrigerant by way of the outdoor coil, condensation, and eventually ice or frost, will tend to form on the coil even at ambient temperatures above the freezing point. Once this ice or frost coats the surface of the heat exchanger, the efficiency thereof is impaired, and overall system efficiency and capacity are decreased. In turn, the temperature of the air supplied to the conditioned space will drop, potentially to an uncomfortable level. Consequently, it is desirable to maintain the evaporator surfaces free from ice or frost. A defrost cycle is therefore periodically used as a normal mode of operating for that purpose.

A conventional manner of defrosting the outdoor coil is that of reversing the refrigerant flow, such that the outdoor coil functions as a condenser with the hot gases that are discharged from the compressor being circulated directly to the outdoor coil to melt the ice that is formed thereon. During this process, the indoor coil section acts as an evaporator with the refrigerant removing heat from the air being blown across it. This air is then returned to the conditioned space at a greatly reduced temperature. This undesirable condition is called "cold blow". One method of reducing "cold blow" is to energize electric resistance heater elements in the supply air stream. In many cases, these elements are not sufficient to overcome the cooling capacity of the system and cold air is still introduced to the conditioned space creating an uncomfortable situation for the occupants. In other cases, these elements are greatly oversized and the supply air temperature becomes high enough to satisfy the room thermostat. This can result in an incomplete defrost cycle as well as unnecessary energy use.

It is therefore an object of the present invention to eliminate "cold blow" during the defrost cycle.

Another object of the present invention is to maintain the temperature in the conditioned space at a comfortable temperature during the defrost cycle.

Yet another object of the present invention is the provision for reducing the time required for a defrost cycle.

Yet another object of the present invention is the provision for eliminating the use of excess electric heat during defrost while providing a complete defrosting cycle for the outdoor coil.

Still another object of the present invention is the provision for a heat pump system which is economical to manufacture and economical and effective in use.

These objects and other features and advantages become more readily apparent upon reference to the following description when taken in conjunction with the appended drawings.

SUMMARY OF THE INVENTION

Briefly, in accordance with one aspect of the invention, provision is made, in a heat pump system operating in the defrost mode, for sensing the temperature of the air being supplied to the conditioned space and responsively turning on sufficient supplemental electric resistance heat to maintain the temperature of the air being supplied to the conditioned space at an acceptable level.

By another aspect of the invention, the electric resistance heat is staged such that only the amount required to maintain a comfortable supply air temperature is used at any one time. In this way the electric heaters are turned on to overcome the cooling effects of the defrost cycle based on an input from the supply air temperature sensor. This staging allows the system to maintain a balance between comfort and energy usage by using only the amount of electric resistance heat required.

By yet another aspect of this invention, the elimination of cold air being introduced into the conditioned space during defrost will eliminate a drop in room temperature which is typical of heat pump systems. This leads to increased comfort of the occupants of the home. In addition, by maintaining a constant room temperature, the defrost cycle can be shortened slightly since the air being drawn across the indoor coil is maintained at a higher temperature, thereby increasing the amount of heat being transferred to the refrigerant.

In the drawings as hereinafter describe, a preferred embodiment is depicted; however, various other modifications and alternate constructions can be made thereto without departing from the true spirit and scope of the invention.

DESCRIPTION OF THE PREFERRED EMBODIMENT

Figure 1:
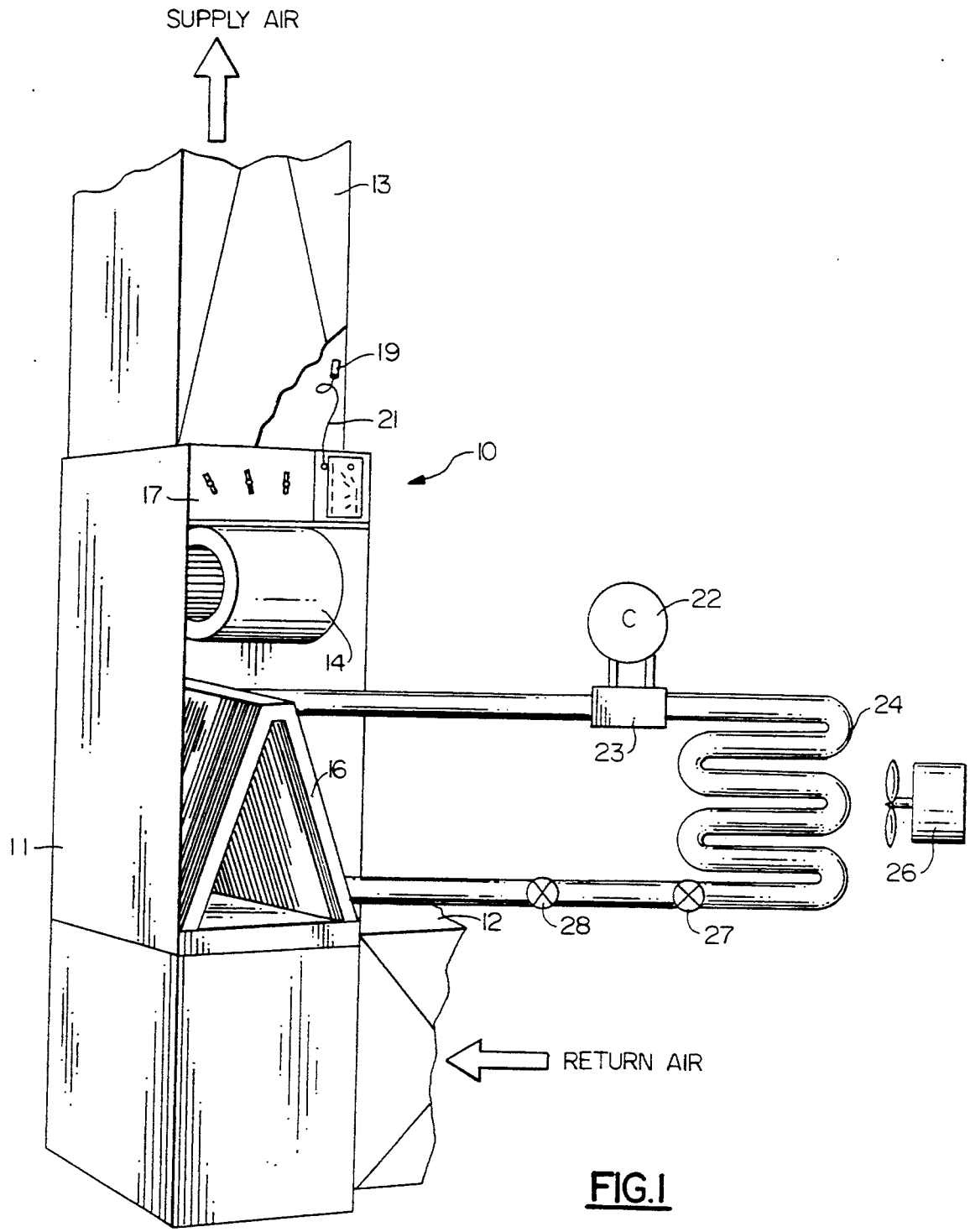
FIG. 1 is a pictorial representation of an indoor coil section of a heat pump system having the present invention incorporated therein.

Referring now to FIG. 1, the invention is shown generally at 10 as incorporated into an indoor coil section 11 having a return air plenum 12, a supply air plenum 13 and a blower motor assembly 14 for drawing the air into the return air plenum 12 and supplying it back to the space to be conditioned by way of the supply air plenum 13. An indoor coil 16 is disposed within the system and has refrigerant circulated therethrough for the purpose of cooling or heating the air passing over the coil 16 as it is circulated through the system. The indoor coil 16 acts as an evaporator in the cooling mode to remove heat from the indoor air and as a condenser in the heating mode to provide heat to the indoor air. During the defrost mode, the system switches from the heating mode to a cooling mode to allow the heat from the indoor air to be transferred by the refrigerant to the outdoor coil to facilitate the defrosting thereof.

An electric heater module 17 is provided just downstream of the blower motor assembly 14, with its electric resistance heater elements being applied as a second stage of heat to supplement the heat pump during low outdoor temperature conditions. This module is also used during the defrost mode to heat the air being supplied to the conditioned space while heat is removed from the return air for the purpose of defrosting the outdoor coil.

A control assembly 18 is provided to control both the electric heater module 17 and the blower motor assembly 14 in response to signals received from a thermostat, outdoor unit control and a temperature sensor 19, such as a thermistor or the like. Thermistor 19 functions to sense the temperature of the air being delivered to the supply air duct 13, with those temperature signals then being provided to the control assembly 18 by way of leads 21 during periods of defrost operation. Generally, when that air is cooler than desired, the control 18 will cause the electric heater module 17 to be turned on to eliminate a "cold blow" situation, and when that air has reached a satisfactory temperature, the thermistor 19 will so indicate that to the control 18, and it will switch the electric heater module 17 to the off position to thereby prevent the use of excess heat.

The indoor coil 16 is connected to a standard closed loop refrigeration circuit which includes a compressor 22 a 4-way valve 23, an outdoor coil 24 with a fan 26 and expansion valves 27 and 28. The 4-way valve 23 is selectively operated by the control assembly 18 to function in the respective cooling, heating, or defrost modes, with either the expansion valve 28 functioning to meter the flow to the indoor coil 16 or the expansion valve 27 functioning to meter the refrigerant flow to the outdoor coil 24. The control assembly 18 can be applied to selectively operate the compressor 22 and the fan 26 as well.

Figure 2:
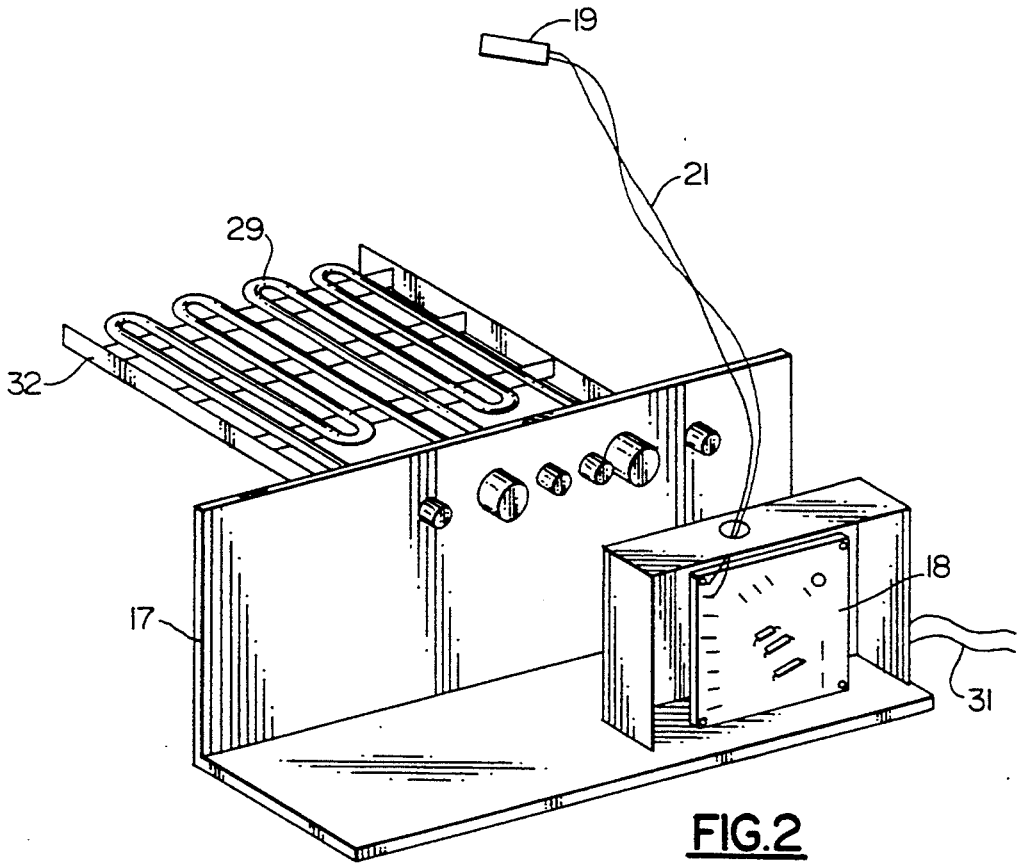
FIG. 2 is a perspective view of the electric heater module portion of a heat pump system having the present invention incorporated therein.

The electric heater module 17 is shown in greater detail in FIG. 2 to include a plurality of electric resistance heating elements 29 which are connected to a pair of power leads 31 by way of the control assembly 18. The heating elements 29 extend rearwardly into the supply air plenum 13 and are vertically supported by a plurality of support rods 32 as shown. These heating elements 29 are typically sized in the 2, 5, or 10 kW element sizes with the heating elements 29 being electrically connected to the control assembly 18 in such a manner as to allow them to be brought into play in a staging fashion in order to provide the desired supplemental heat and defrost warming of the air being delivered to the supply air plenum 13. The thermistor 19 is preferably placed in a position within the supply air plenum such that it is able to sense the air temperature therein, but is not directly heated by the radiated heat from the electric resistance heating elements 29. A shield may be used to isolate the thermistor 19 from the radiated heat of the heating elements 29.

Figure 3:
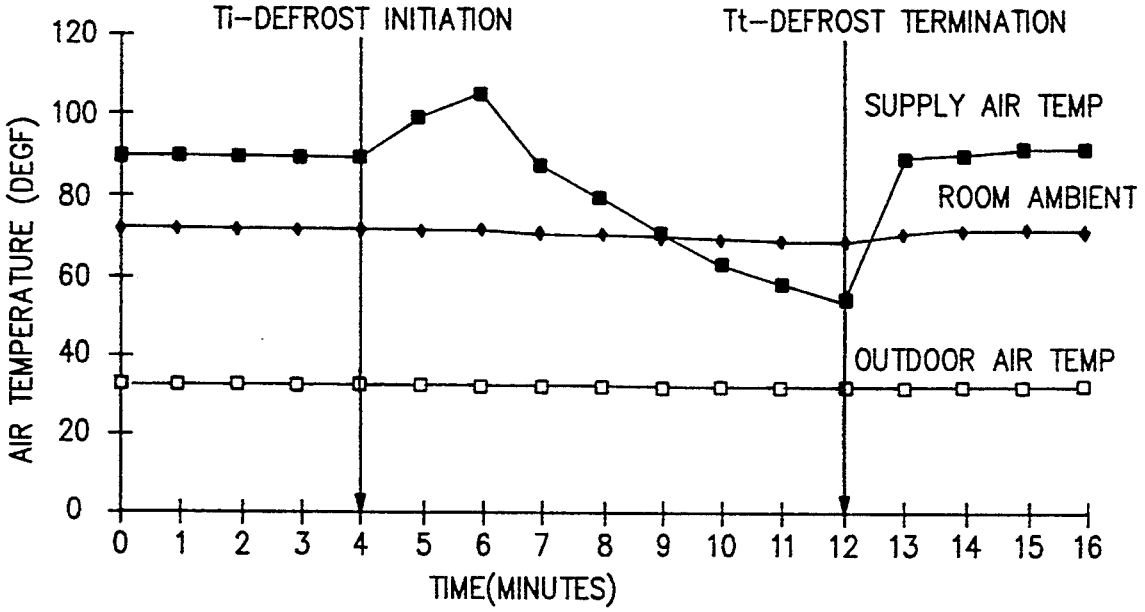
FIG.3 Prior Art
FIG. 3 is a graphic illustration of the supply air, room ambient and outdoor air temperatures during defrost as a function of time for a typical prior art heat pump system with insufficient electric resistance heat.

Referring now to FIG. 3, the supply air temperature is shown as a function of outdoor air temperatures and room temperatures during a defrost operation in a prior art heat pump system wherein there is insufficient electric resistance heat to prevent a "cold blow" condition. It should first of all be recognized that frost will form on the outdoor coil during defrost when the outdoor ambient temperature drops below 35° F. Assuming a constant 30° F. outdoor ambient temperature, during normal heating conditions the room ambient temperature is maintained at the thermostat set point of 72° F. Under these conditions, the supply air temperature is typically 15°–40° over the room ambient, and in the present case is 18° over the room ambient, or 90° F.

When defrost operation is initiated at Ti, the heat pump is caused to operate in the reverse, or cooling, mode, with the indoor coil 16 functioning as an evaporator to take heat from the indoor air and transfer it to the outdoor coil by way of the refrigerant. Since the electric heaters are turned on upon defrost initiation, the supply air temperature initially rises for a couple of minutes to 106° F. As the defrost cycle continues beyond this point, the heat pump system begins to take out more heat from the air than the electric heater is able to add, thus causing the supply air temperature to begin to drop. This continues until the defrost operation is terminated, with the supply air temperature eventually dropping to as low as 54°. This not only causes the room ambient temperature to drop (i.e. about 3° F.), but also, the low temperature supply air that is flowing into the room is perceived as a draft, or "cold blow" by the homeowner. After the termination of defrost, the system is again changed to a heating mode, and the supply air, which is still being heated by way of the supplementary electric heat, will fairly quickly heat up to the desired temperature of 90°, and even a little higher, to then bring the room ambient temperature up to the desired set point temperature of 72° F.

Figure 4:
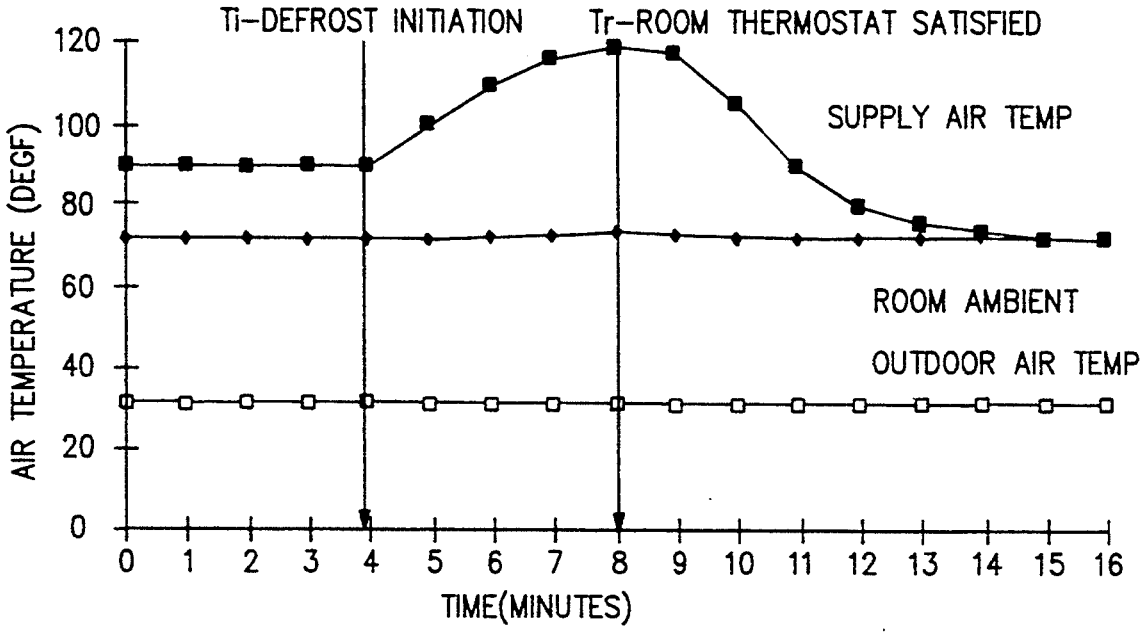
FIG.4 Prior Art
FIG. 4 is a graphical illustration of the supply air, room ambient and outdoor air temperatures during defrost as a function of time for a typical prior art heat pump system with oversized electric resistance heating elements.

In FIG. 4, the same conditions are again assumed, except that instead of having an electric resistance heater that is too small, it is assumed that the heater is oversized. Again, during normal heating operation, the supply air temperatures and the room ambient temperatures are maintained substantially constant. Upon defrost initiation at Ti, the cycle is reversed to the cooling mode and the oversized heater is caused to come on. Since the heat being provided by the heater is greater than the amount of heat that is being used for the defrost operation, the supply air temperature rises fairly rapidly, and within four minutes has reached 120° F. Because of the increased supply air temperature, the room ambient temperature gradually increases from 72° to 74° F., at which time the thermostat becomes satisfied. This, in turn, causes the heat pump system to shut down at a time when the defrosting has not been completed. Since the electric heat will also be turned off at this point, the supply air temperature then drops fairly rapidly to the level of the room ambient temperature, and the room ambient temperature will also tend to drop until it is low enough to initiate a call for heat, and the cycle is then repeated. The result is therefore that, not only does the outdoor coil not become completely defrosted, but the room ambient temperature also tends to swing through uncomfortable temperature changes.

Figure 5:
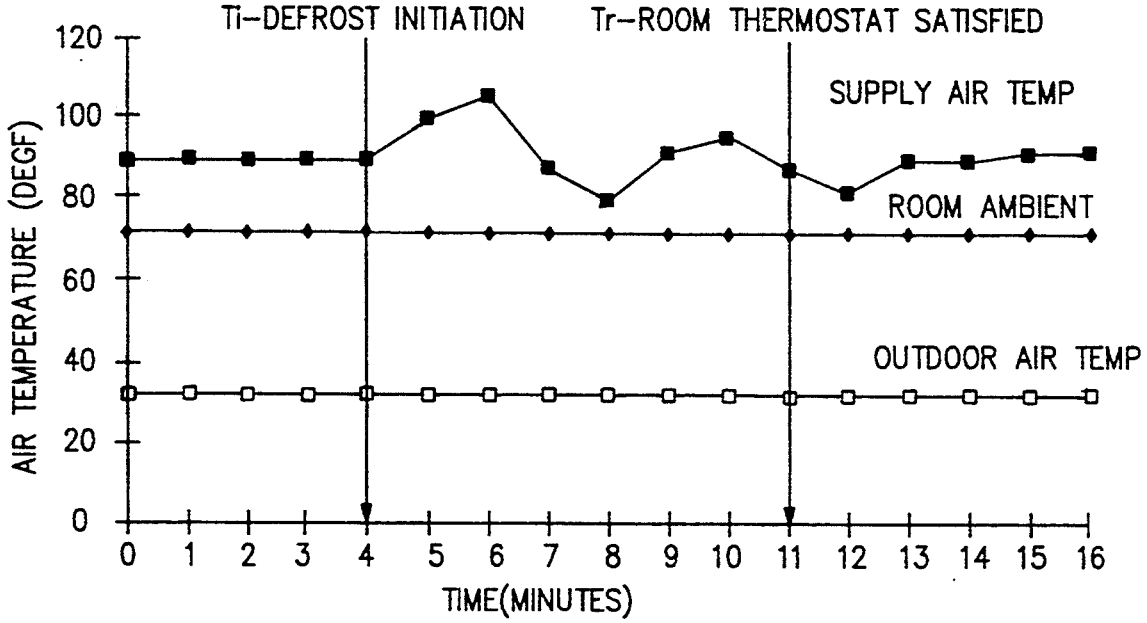
FIG. 5 is a graphical illustration of the supply air, room ambient and outdoor air temperatures during defrost as a function of time for a heat pump system operating in accordance with the present invention.

As will be seen, there are adverse effects when the heat provided by the electric heater is either too small or too large to compensate for the heat being removed by the defrost cycle. Since it is difficult to provide a coil that is exactly the right size, for a range of outdoor ambient conditions, the present invention is designed to more closely sense an adverse condition to regulate the supplementary heat accordingly. The graph at FIG. 5 represents the operational temperatures that result from the application of the present invention as described hereinabove.

At the initiation of defrost, the system is reversed to operate in a cooling mode with heat being drawn away from the supply air duct to effect the defrost operation. Again, the electrical heat is turned on at defrost initiation and, initially, the supply air temperature begins to rise to about 106°, but then begins to drop as the amount of heat being pulled off for defrost is greater than that being provided by the electric heat input. When this occurs, the thermistor 19 of the present invention senses the temperature drop, and when it drops below the 90° F. threshold, the thermistor 19 sends a signal to the controller 18, which in turn causes another set of electric heaters to be turned on and to remain on until the defrost is terminated or until another predetermined threshold is reached. The heat from this additional stage of electric heaters will overcome the "cold blow" that is typically experienced during defrost. As a result, the room ambient temperature remains constant during defrost as shown. This higher room ambient temperature also results in a slightly shorter defrost time since there is more heat available in the return air duct than there would be with the decreased room ambient temperature as shown in FIG. 3.

Rather than having a single stage of additional heaters that can be turned on when the temperature of the supply air reaches a predetermined level, there may be multiple stages that can be turned on and off in a sequential manner so as to maintain an even greater uniformity of supply air temperatures and thus greater comfort in the room being heated.

Although the present invention has been shown and described with respect to preferred and modified embodiments, it will be understood by those skilled in the art that various changes in the form and detail thereof may be made without departing from the true spirit and scope of the claimed invention.

What is claimed is:

1. An improved method of defrosting an outdoor coil of a heat pump system having a supplemental heater for heating the air stream passing from an indoor coil to an air supply duct during defrost operation, comprising the steps of:

providing at least one additional heater for heating air passing from the indoor coil to the air supply duct during defrost operation;

sensing when the temperature of the air being delivered to the air supply duct decreases to a predetermined level; and responsively turning on said at least one additional heater when said predetermined level is so sensed.

2. An improved method as set forth in claim 1 wherein said at least one additional heater comprises multiple heaters that are turned on in stages.

3. An improved method as set forth in claim 1 and including a preliminary step of turning on said supplemental heater at the time that a defrost cycle is initiated.

4. An improved method as set forth in claim 1 wherein the step of turning on said additional heaters is accomplished by sequentially turning on multiple additional heaters as the temperature of the air being delivered to the air supply duct decreases to respective predetermined levels.

5. An improved method as set forth in claim 1 wherein said additional heaters are turned on only as needed to overcome the cooling effects caused by defrosting the outdoor coil.

6. An improved heat pump system of the type having outdoor and indoor heat exchange coils with associated fans, a compressor, an expansion device, means for reversing the flow of refrigerant for purposes of selecting between heating, cooling, and defrost modes of operation and a supplemental heater for heating an air stream passing from the indoor coil to an air supply duct during defrost operation, wherein the improvement comprises:

at least one additional heater for heating air passing from the indoor coil to the air supply duct during defrost operation;

sensing means for sensing when the temperature of the air being delivered to the air supply duct decreases to a predetermined level;

and control means for responsively turning on said at least one additional heater when said predetermined level is so sensed.

7. An improved heat pump system as set forth in claim 6 wherein said sensing means is a thermistor located in the air supply duct.

8. An improved heat pump system as set forth in claim 6 wherein said at least one additional heater is located in the air supply duct.

9. An improved heat pump system as set forth in claim 6 wherein the indoor fan is disposed between the indoor heat exchange coil and said at least one additional heater to cause return air to flow first across the indoor coil and then across said at least one additional heater.

10. An improved heat pump system as set forth in claim 6 wherein said control means is responsive to turn on said supplemental heater at the same time that the defrost mode is initiated.

11. An improved heat pump system as set forth on claim 6 wherein said control means is responsive to sequentially turn on multiple additional heaters as the temperature of the air being delivered to the air supply duct decreases to predetermined levels.

12. An improved heat pump system as set forth in claim 6 wherein said control means allows for complete defrost of said outdoor coil by turning on said additional heaters in stages.

13. An improved heat pump system as set forth in claim 6 wherein said control means reduces the amount of electric resistance heat that is applied by turning on said additional heaters only as needed to overcome the cooling effects caused by defrosting the outdoor coil.

14. An improved heat pump system as set forth in claim 6 wherein said control means is responsive to maintain a constant indoor temperature during defrost operation.

* * * * *